US006871921B2

(12) United States Patent
Ernst

(10) Patent No.: US 6,871,921 B2
(45) Date of Patent: Mar. 29, 2005

(54) DIVIDER ASSEMBLY FOR A DRAWER

(76) Inventor: Gregory R. Ernst, 15735 SE. Bartell Rd., Boring, OR (US) 97009

( * ) Notice: Subject to any disclaimer, the term of this patent is extended or adjusted under 35 U.S.C. 154(b) by 0 days.

(21) Appl. No.: 10/353,469

(22) Filed: Jan. 28, 2003

(65) Prior Publication Data

US 2004/0145287 A1 Jul. 29, 2004

(51) Int. Cl.[7] ..... A47B 88/00
(52) U.S. Cl. ..... 312/348.3; 312/330.1; 312/348.1; 220/529
(58) Field of Search ..... 312/348.3, 330.1, 312/348.1; 220/529, 530, 532, 533, 534, 541, 542, 543, 545, 546, 548, 549, 552

(56) References Cited

U.S. PATENT DOCUMENTS 1,995,335 A * 3/1935 Wilke ..... 312/140
4,258,856 A * 3/1981 Marling ..... 220/552
4,346,813 A * 8/1982 Cho et al. ..... 220/532
4,971,201 A * 11/1990 Sathre ..... 206/509
5,180,217 A * 1/1993 Lautenschlager ..... 312/334.7
5,678,909 A * 10/1997 Cheng et al. ..... 312/348.2
6,073,794 A * 6/2000 Bidot ..... 220/529
6,357,844 B1 * 3/2002 Muterthies et al. ..... 312/348.3

* cited by examiner

*Primary Examiner*—Peter M. Cuomo
*Assistant Examiner*—Erika Garrett
(74) *Attorney, Agent, or Firm*—James D. Givnan, Jr.

(57) ABSTRACT

A divider assembly for installation in a tool box or chest drawer to provide separate drawer areas for the storage of various grouped articles. Perimeter rails are joined by corner clips to maintain a rectangular shape of the divider assembly. Divider rails extend intermediate perimeter rails to form storage areas of various shapes and sizes. Divider clips receive the divider rail ends. Projections and recesses on the divider clips and the perimeter rail members confine the divider rails against displacement. Flexure of the divider clips permit snapped engagement of the clips with the perimeter rail member.

2 Claims, 2 Drawing Sheets

DIVIDER ASSEMBLY FOR A DRAWER

BACKGROUND OF THE INVENTION

The present invention concerns generally a divider permitting the forming of multiple storage areas within a drawer.

A problem exists in the provision of storage areas within tool box or tool cabinet drawers wherein it is frequently desirable that each drawer has several storage areas of different sizes for the size and number of components to be stored. Known dividers are impractical in that they often do not fully utilize drawer space nor are they readily changeable to accommodate a wide range of different sized articles. Further, known dividers do not always provide components that resist shifting within the tool box or tool chest drawer and do not lend themselves to rapid removal, reconfiguration and reinstallation in a drawer. A still further shortcoming of known dividers is that they result in a right angular intersection of a divider vertical surface and the drawer bottom hindering the removal of a specific small article from the drawer.

SUMMARY OF THE PRESENT INVENTION

The present invention is embodied within a divider assembly to permit convenient assembly of a range of storage areas within a drawer in a semi-permanent manner.

The present divider assembly utilizes components that permit selective positioning of divider rails and rails forming the perimeter of the assembly in a rapid but secure manner to prevent undesired shifting or separation of joined components. Projections and recesses on the components permit snapped engagement of same by manual effort and taking advantage of the somewhat yieldable nature of the molded components. Rails of the assembly permit sizing of same to adapt the assembly to a wide range of drawer sizes. Provision is made in the divider rails and divider clips to accept rails cut by the installer to less than exact dimensions to facilitate sizing and assembly of the present divider assembly to suit specific drawer sizes. Clips attaching a divider rail to a perimeter rail are snapped into place without the aid of tools.

DETAILED DESCRIPTION OF THE PREFERRED EMBODIMENTS

Figure 1:
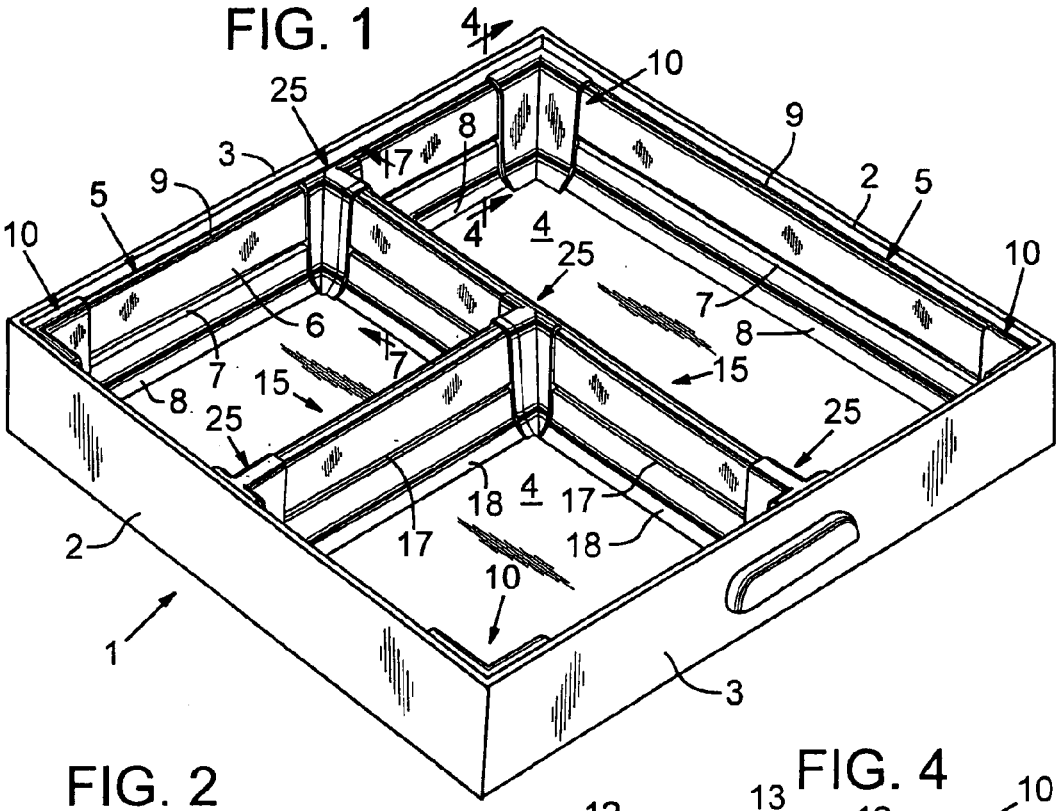
FIG. 1 is a view of the present divider assembly in a drawer.

With continuing attention to the drawings wherein applied reference numerals indicate parts similarly hereinafter identified, the reference numeral 1 indicates generally a drawer having sides 2, and front and rear components 3, and a bottom wall 4. Drawer 1 is typical of drawers found in various types of cabinets including tool cabinets and tool boxes. Appendages for slidably mounting such a drawer are not shown.

Figure 2:
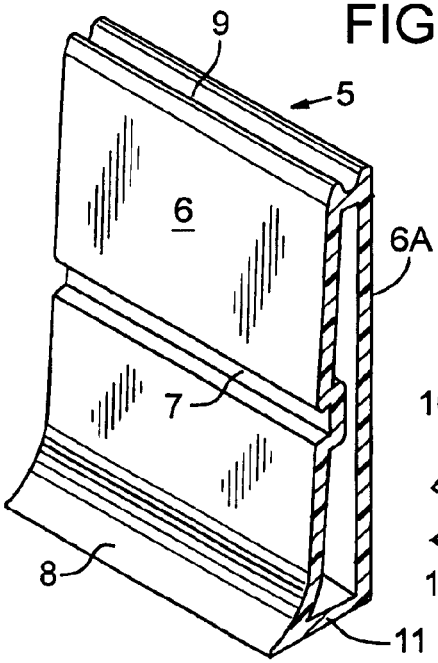
FIG. 2 is a perspective view of a segment of a perimeter rail.

With attention now to the present divider assembly, the reference numeral 5 indicates a perimeter rail in place on a drawer bottom wall 4. With attention additionally to FIG. 2, it will be seen that a perimeter rail has an upright wall 6 while a channel or recess 7 extends lengthwise of the wall. A bottom portion of wall 6 preferably includes an inwardly sloped segment 8 to facilitate grasping of loose articles stored in an area partially defined by perimeter wall 5. The wall terminates upwardly in a lengthwise top groove at 9. When in place on a drawer bottom, a back wall 6A of the rail will abut the inner surface of a drawer wall 2 or 3. A rail bottom is at 11. Perimeter rails 5 are joined at their extremities by corner clips at 10.

Figure 3:
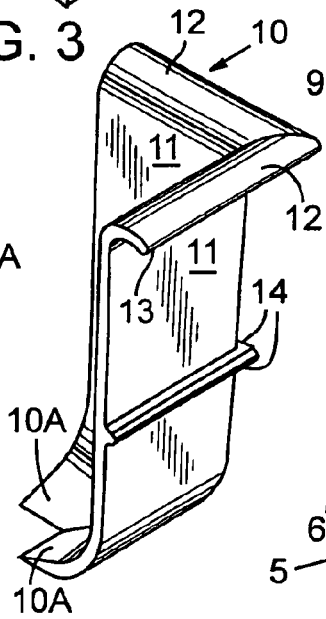
FIG. 3 is a perspective view of a corner clip.
Figure 4:
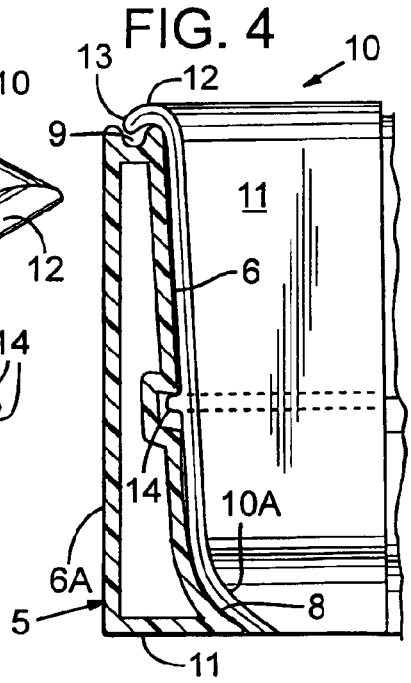
FIG. 4 is a vertical sectional view taken along line 4—4 of FIG. 1.

The corner clips 10, as best shown in FIG. 3 and FIG. 4, each include intersecting upright walls 11 terminating upwardly in curved top segments 12 with an outer edge 13. Walls 11 each additionally carries a rib 14 integral with the wall. With attention to the lower portion of the corner clip, each wall 11 terminates, in a preferred form of the invention, in an inwardly and inclined lower segment 15 10A for rested placement on bottom 4 of the drawer. The corner clip walls 11 are right angular for placement adjacent each of the drawer corners. The upper ends 13 of the corner pieces engage the recessed or grooved areas 9 of the perimeter rails.

Figure 5:
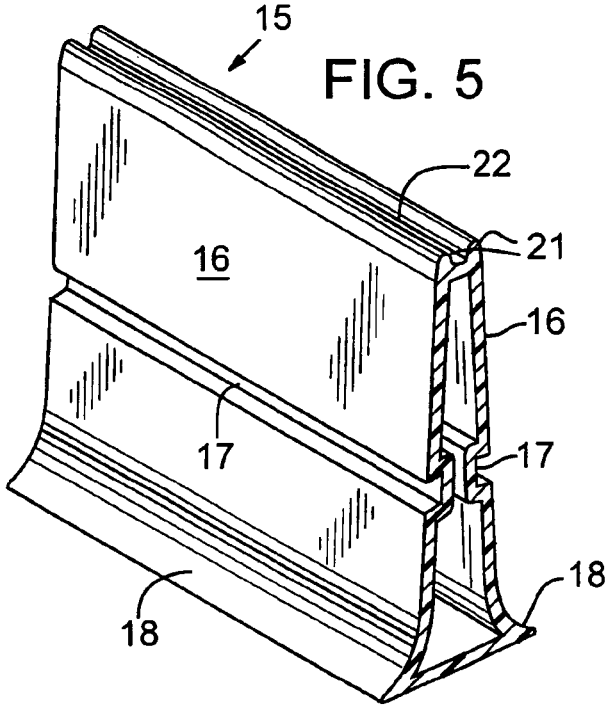
FIG. 5 is a perspective view of a fragment of a divider rail.
Figure 7:
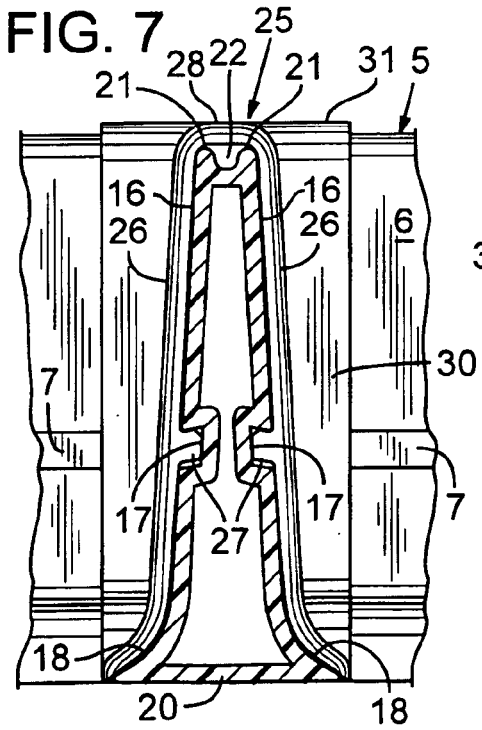
FIG. 7 is a sectional view taken along line 7—7 of FIG. 1.

Divider rails as at 15 serve to define storage areas within the drawer and may extend crosswise or lengthwise of the drawer either fully or partially. With attention to FIG. 5 and FIG. 7, it will be seen that the divider rails are of molded construction having upright walls 16 each defining a channel 17 midway of the wall height and extending lengthwise. A curved sloped lower segment is at 18 which terminates at the divider rail bottom wall 20. The wall 16 terminates upwardly in ridges 21 defining a top groove 22 extending lengthwise of the rail.

Figure 6:
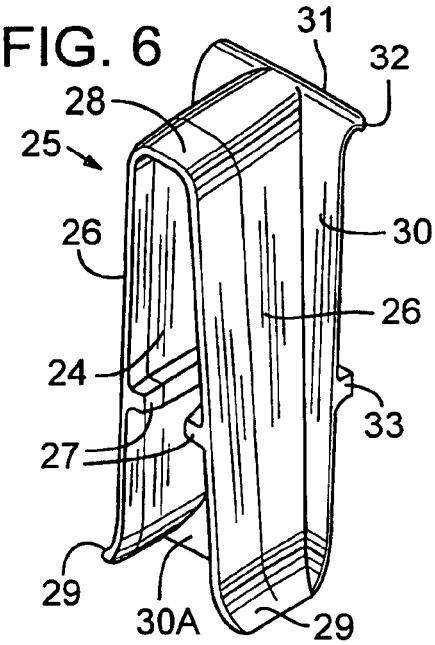
FIG. 6 is a perspective view of a divider clip.

Indicated at 25 are divider clips which securely attach the ends of the divider rails to the perimeter rails. With attention to FIG. 6, a divider clip is indicated at 25 and includes a pair of walls 26 which define an open area 24 for insertion of a divider rail end. Inwardly projecting ribs at 27 permit divider rail insertion by sliding engagement with the recessed areas 17 of the rail. An upper end 28 of the divider clip is formed by merging of the walls 26. Lower segment 29 of each divider clip 25 is curved to overlie the curvature 18 of the divider rail.

For purposes of divider clip attachment to a perimeter rail, the divider clip includes an end wall 30 which, in a horizontal section of the divider clip, is at right angles to wall 26 of the clip and is inclined somewhat so as to closely overlie wall 6 and the curved lower segment 8 of a perimeter rail. Wall 30 terminates upwardly in a curved end 31 with a distal edge 32 for engagement with the recessed area or groove 9 of the perimeter rail. Further, divider clip wall 30 carries a rib 33 extending transversely of the wall for engagement with a perimeter wall recess 7. Accordingly, a divider clip 25 is secured by rib 33 against tipping by loads being imparted laterally of the divider rail. Wall 30 terminates downwardly in an inwardly curved segment 30A.

Figure 8:
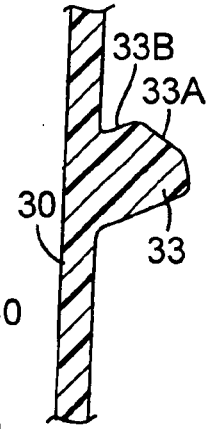
FIG. 8 is a fragmentary elevational view of a divider clip.
Figure 9:
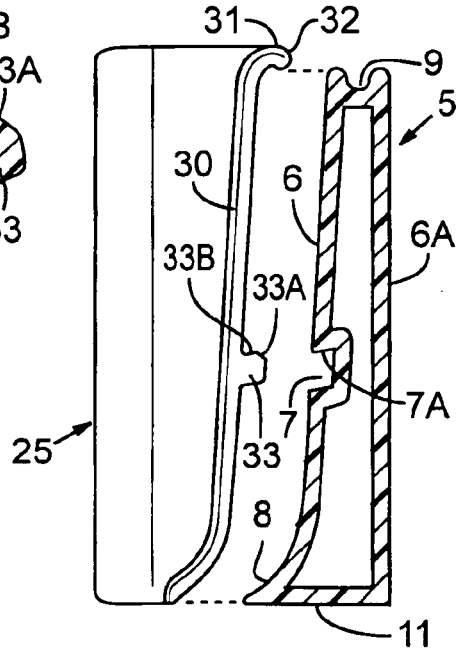
FIG. 9 is a sectional view of a perimeter rail with a divider clip partially installed.

Divider clip 25, with a divider rail attached, is attached to a perimeter rail in secure fashion as shown in FIG. 9. Rib 33 on clip wall 30 has a bevel at 33A (FIG. 8) which facilitates passage of rib 33 into recess 7 in the perimeter rail wall 6 in snap fashion as a degree of flexing of the clip occurs during seating of the rib. The recess 7 is undercut at 7A to retain the upwardly inclined surface 33B (FIG. 8) on rib 33. Detachment of a divider clip 25 from a perimeter rail is accomplished by the insertion of a blade screw driver tip into groove 9 to lift distal edge 32 from the groove and rib 33 away from recess 7.

To form a storage area of reduced size, divider clips 25, on a divider rail of lesser length, are attachable to a previously installed divider rail 15 and to a perimeter rail 5. The divider clip curved upper portion 31, will rest in groove 22 of a divider rail 15 while wall 30 of a second clip will lie flush with perimeter rail wall 6 with rib 33 seating in recess 7. Lower curved segment 30A (FIG. 6) of a divider clip will rest on the lower curved segment 8 of the perimeter rail wall 6.

While I have shown but one embodiment of the invention, it will be apparent to those skilled in the art that the invention may be embodied still otherwise without departing from the spirit and scope of the claimed invention.

I claim:

1. A divider assembly for a storage drawer and including, perimeter rails each defining a groove along their upper extremity, corner clips joining said rails, a divider rail located in the area defined by the perimeter rails flexible divider clips for attachment to at least two of said perimeter rails and to said divider rail, said divider clips each having a distal edge for inserted engagement with a perimeter rail groove, said perimeter rails and said flexible divider clips having lengthwise channels and ribs respectively engaged with one another, said ribs integral with said flexible divider clips, each of said ribs having a bevel to facilitate insertion into one of said lengthwise channels.

2. The divider assembly claimed in claim 1 wherein said perimeter rails and said divider rail include inclined sloped segments to facilitate manual tool retrieval.

* * * * *